US011453190B2

(12) United States Patent
Boegli et al.

(10) Patent No.: US 11,453,190 B2
(45) Date of Patent: Sep. 27, 2022

(54) METHOD AND EMBOSSING STRUCTURE FOR MAXIMIZING PRESSURE BUILDUP AT ROTATIONAL EMBOSSING OF FOILS

(71) Applicant: BOEGLI-GRAVURES SA, Marin-Epagnier (CH)

(72) Inventors: Charles Boegli, Marin-Epagnier (CH); Werner Steffen, Stans (CH)

(73) Assignee: BOEGLI-GRAVURES SA, Marin-Epagnier (CH)

( * ) Notice: Subject to any disclaimer, the term of this patent is extended or adjusted under 35 U.S.C. 154(b) by 124 days.

(21) Appl. No.: 16/470,624

(22) PCT Filed: Dec. 19, 2017

(86) PCT No.: PCT/IB2017/058121
§ 371 (c)(1),
(2) Date: Jun. 18, 2019

(87) PCT Pub. No.: WO2018/116156
PCT Pub. Date: Jun. 28, 2018

(65) Prior Publication Data

US 2020/0086600 A1 Mar. 19, 2020

(30) Foreign Application Priority Data

Dec. 20, 2016 (EP) ..... 16205224

(51) Int. Cl.
*B31F 1/07* (2006.01)

(52) U.S. Cl.
CPC ..... *B31F 1/07* (2013.01); *B31F 2201/0717* (2013.01); *B31F 2201/0733* (2013.01);
(Continued)

(58) Field of Classification Search
CPC ..... B31F 2201/0717; B31F 2201/0733; B31F 2201/0738; B31F 2201/0753;
(Continued)

(56) References Cited

U.S. PATENT DOCUMENTS 3,264,978 A * 8/1966 Staley ..... B31F 1/07 101/23
3,673,839 A 7/1972 Nielsen et al.
(Continued)

FOREIGN PATENT DOCUMENTS

AU 772613 B2 11/2000
CA 2367423 C 9/2000
(Continued)

OTHER PUBLICATIONS

International Search Report for PCT/IB2017/058121, dated Apr. 3, 2018, 4 pages.
(Continued)

*Primary Examiner* — Thomas M Wittenschlaeger
(74) *Attorney, Agent, or Firm* — Nixon & Vanderhye P.C.

(57) ABSTRACT

An embossing method allowing to emboss a material on both sides comprises feeding the foil material into a roll nip between a pair of a first roll and a second roll, providing the first roll and the second roll each with a plurality of positive projections and a plurality of negative projections of identical shaped polyhedral structures, a first subset of the plurality of positive projections being disposed with a first periodicity on a first grid in axial direction and a second periodicity on the first grid in circumferential direction on the first roll, and a second subset of the plurality of negative projections being disposed with the first periodicity in axial direction and the second periodicity in circumferential direction on the first grid intertwined with the positive projec-
(Continued)

tions, in axial and circumferential directions respectively, and projections complementary to the first grid, on the second roll, each of the positive projections and the negative projections on the first roll during operation of the rolls and in the roll nip being surrounded on all sides by positive projections and negative projections on the second roll, the positive projections of the first roll together with alternating corresponding negative projections on the second roll forming during the operation of the rolls and in the roll nip, a first straight line substantially parallel to the axial direction, and the negative projections of the first roll together with alternating corresponding positive projections on the second roll forming during the operation of the rolls and in the roll nip, a second straight line substantially parallel to the axial direction. The positive projections and the negative projections are such that in the axial direction on the first roll each positive projection shares a lateral base border with at least one negative projection adjacent to the positive projection, and during the operation of the rolls and in the roll nip, all lateral oblique surfaces of the positive and negative projections of the first roll are just above the surface in full faced view with the corresponding lateral oblique surfaces of the respective negative and positive projections of the second roll, thereby enabling a homogeneous distribution of pressure to the material.

21 Claims, 12 Drawing Sheets

(52) U.S. Cl.
CPC ..... *B31F 2201/0738* (2013.01); *B31F 2201/0743* (2013.01); *B31F 2201/0753* (2013.01)

(58) Field of Classification Search
CPC ..... B31F 2201/0743; B31F 2201/0723; B31F 2201/0735; B31F 1/0019; B31F 1/22; B31F 1/0009; B31F 1/26
See application file for complete search history.

(56) References Cited

U.S. PATENT DOCUMENTS

| | | | | |
|---|---|---|---|---|
| 5,007,271 | A | 4/1991 | Boegli | |
| 5,203,761 | A * | 4/1993 | Reichental | B26D 1/185 493/346 |
| 5,598,774 | A | 2/1997 | Boegli | |
| 6,176,819 | B1 | 1/2001 | Boegli et al. | |
| 6,665,998 | B1 | 12/2003 | Boegli | |
| 6,715,411 | B1 | 4/2004 | Boegli | |
| 6,913,673 | B2 * | 7/2005 | Baggot | B31F 1/07 156/209 |
| 7,036,347 | B2 | 5/2006 | Boegli | |
| 7,147,453 | B2 | 12/2006 | Boegli | |
| 7,229,681 | B2 * | 6/2007 | Boegli | B29C 59/022 101/23 |
| 8,038,922 | B2 | 10/2011 | Boegli | |
| 8,430,663 | B2 | 4/2013 | Boegli | |
| 8,495,900 | B2 | 7/2013 | Boegli | |
| 8,932,044 | B2 | 1/2015 | Boegli | |
| 9,108,355 | B2 * | 8/2015 | Kume | B29C 65/18 |
| 9,140,834 | B2 | 9/2015 | Boegli | |
| 9,156,107 | B2 | 10/2015 | Boegli et al. | |
| 9,180,643 | B2 | 11/2015 | Boegli | |
| 9,481,141 | B2 | 11/2016 | Boegli | |
| 9,505,167 | B2 * | 11/2016 | Boegli | B31F 1/07 |
| 9,579,924 | B2 * | 2/2017 | Boegli | B23K 26/362 |
| 9,636,885 | B2 | 5/2017 | Boegli et al. | |
| 9,809,927 | B2 * | 11/2017 | Boegli | B31F 1/07 |
| 9,939,725 | B2 | 4/2018 | Boegli et al. | |
| 9,993,895 | B2 | 6/2018 | Boegli et al. | |
| 10,083,253 | B2 | 9/2018 | Boegli et al. | |
| 10,183,318 | B2 | 1/2019 | Boegli et al. | |
| 10,603,229 | B2 * | 3/2020 | Trinkaus | A61F 13/15577 |
| 2003/0021953 | A1 * | 1/2003 | Graff | B31F 1/07 428/153 |
| 2004/0076798 | A1 * | 4/2004 | Larsson | B31F 1/07 428/153 |
| 2004/0151796 | A1 * | 8/2004 | Boegli | B29C 59/04 425/364 R |
| 2005/0247397 | A1 | 11/2005 | Kraus et al. | |
| 2005/0279147 | A1 | 12/2005 | Boegli | |
| 2005/0280182 | A1 * | 12/2005 | Boegli | B29C 59/04 264/284 |
| 2010/0061619 | A1 | 3/2010 | Boegli | |
| 2012/0018993 | A1 | 1/2012 | Boegli et al. | |
| 2012/0064298 | A1 * | 3/2012 | Orr | B26F 1/26 428/156 |
| 2012/0292821 | A1 | 11/2012 | Boegli | |
| 2014/0059977 | A1 | 3/2014 | Boegli | |
| 2015/0059599 | A1 | 3/2015 | Boegli | |
| 2016/0075077 | A1 | 3/2016 | Boegli et al. | |
| 2017/0066079 | A1 | 3/2017 | Reisse et al. | |
| 2017/0282635 | A1 | 10/2017 | Boegli et al. | |
| 2018/0220698 | A1 * | 8/2018 | Boegli | B65B 61/025 |
| 2018/0370175 | A1 * | 12/2018 | Boegli | B31F 1/07 |
| 2020/0324505 | A1 * | 10/2020 | Boegli | B31B 50/88 |

FOREIGN PATENT DOCUMENTS

| | | | |
|---|---|---|---|
| CA | 2382597 | A1 | 11/2000 |
| DE | 202017105458 | U1 | 12/2017 |
| EP | 1867470 | A1 | 12/2007 |
| EP | 2572820 | A1 | 3/2013 |
| EP | 2653301 | A1 | 10/2013 |
| EP | 3300612 | A1 | 4/2018 |
| EP | 3415306 | A1 | 12/2018 |
| GB | 1 312 359 | | 4/1973 |
| WO | 2007/012215 | A1 | 2/2007 |
| WO | 2017/208092 | A1 | 12/2017 |

OTHER PUBLICATIONS

Written Opinion of the ISA for PCT/IB2017/058121, dated Apr. 3, 2018, 4 pages.
Examination Report dated Apr. 23, 2021, issued in India Application No. 201917026924, 7 pages.

* cited by examiner

METHOD AND EMBOSSING STRUCTURE FOR MAXIMIZING PRESSURE BUILDUP AT ROTATIONAL EMBOSSING OF FOILS

This application is the U.S. national phase of International Application No. PCT/IB2017/058121 filed 19 Dec. 2017, which designated the U.S. and claims priority to EP Patent Application No. 16205224.5 filed 20 Dec. 2016, the entire contents of each of which are hereby incorporated by reference.

TECHNICAL FIELD

The invention is in the field of foil embossing. More particularly the invention relates to a method for making embossing rolls, and their use in a pair for embossing foils.

BACKGROUND

The area of fine embossing of thin foils having a thickness in an approximative range from 30 μm to 120 μm using the rotational process, the foils being intended for packaging uses or decorative purposes, has been gaining in interest since the 1980s.

It is well known in the tobacco industry and food industries to emboss packaging foils using rotational embossing with rolls. Such packaging foils may for example be so-called innerliners that are intended to be wrapped around a bunch of cigarettes, or to be used as packaging material for chocolate, butter or similar food products, as well as electronics, jewelry or watches.

The innerliners used to be made from pure aluminium foils, such as aluminium foils use in households. These foils were embossed by feeding them into a roll nip between a pair of rolls. At least one the rolls comprised a topographical structure that defined for example a logo. Until the 1980s such a pair of rolls would comprise mostly one steel roll on which a profile would be formed, and a counter roll made from a resilient material, e.g., rubber, paper or plexiglas. The imprinting or embossing of the profile of the logo carrying roll, also called the pater roll, into the counter roll, also called the mater roll, would allow to obtain the mirror imprint of the logo in the foil.

More demanding logos would require to reproduce the topography of the pater roll in a layer of the mater roll, and the recessed parts on the mater roll corresponding to elevated parts of the pater roll would be excavated by etching or any other appropriate process. More recently such excavating and carving as been obtained using lasers. Since the achievable tolerances were limited, the recesses could only be made in a relatively coarse grid, and were then used in the cooperation between a dedicated pater roll and mater counter roll. It was therefor always necessary to produce spare rolls in pairs, which is expensive. This made the manufacturing of such rolls prohibitively expensive for industrial embossing of for example inner-liners for the tobacco industry.

In the search for an alternative embossive solution, from 1980 on, and following the filing of US patent application underlying U.S. Pat. No. 5,007,271 to the present applicant, a so-called pin up-pin up system has been introduced, wherein two identical steel rolls carrying a very large number of small teeth that intertwine to grip between each other and embossed paper that is fed in between. Logo are embossed by leaving out teeth entirely or partly from one of the rolls. Technical manufacturing constraints imposed between a roll and the counter roll a distance of a half step-length—this prohibited any brilliant embossing if any risk of perforating the material to be embossed was to be avoided.

However the pin up-pin up made it possible to produce a so-called satinizing whereby a large number of small recesses produced by the teeth give to the surface a matt, velvet-like appearance—which incidentally confers a more distinguished look to the embossed material.

Parallel to the evolution in the embossing technology and the manufacture of embossing rolls, there was also a change in the area of packaging materials. The initially massive aluminium foils were replaced by paper foils which surfaces were coated with a thin metal layer, which has been getting thinner ever since the beginning for obvious environmental reasons. Most recently the metal layer was sputtered on the paper surface. It is expected that the metalization of the paper surface will become even thinner in future, or perhaps entirely disappear.

There are also considerations to depart from the classic cigarette packaging, wherein the cigarettes are wrapped in an innerliner, and this pack of wrapped cigarettes is stuck into a cardboard case. It is aimed to use instead so-called soft-packages, wherein there is merely an outer wrapping foil that performs both functions of firstly keeping the humidity inside the cigarettes and protecting the cigarettes from outer odours, and secondly conferring a determined stiffness to the package to mechanically protect the cigarettes.

The development of the roll manufacturing technology, in particular as known from the present applicant in for example U.S. Pat. No. 7,036,347, is allowing an ever larger diversity of decorative effects on innerliners and attractive visual effects for publicity. This is widely being used in the tobacco industry and in the food industry. There is however an incentive to reduce and sometimes eliminate the publicity, and hence it will not anymore be possible to emboss visually effective publicity to the same extent as today.

It is to be considered also that a fine embossing may only be achieved at the expense of a high cost and tremendous efforts for the manufacturing of appropriate rolls. Also, in such a case, wenn a pater roll and an inversely congruent mater roll are used to compress a foil that is passed between them, there are tensions produced in axial direction, which are unacceptable for the tobacco product paper. Moreover there is a difficult to master limit to the occurrence of holes and very high pressures are required in an online highspeed process, in which the embossing time lies in the millisecond range. Finally, there appears to be a tendency to use thicker qualities of paper.

Patent publication EP3038822 describes fine embossing for surface structures as described and mentioned herein above, and for various types of materials in an online process, whereby this encompasses figurative patterns and topographies. In EP3038822 fine embossing comprises that the outlines of fine embossing structures on the rolls have a total linear mistake of less than +/−10 μm and an angle error of less than 5°.

Inverse congruent pairs of rolls allow as described in EP3038822 to produce surface logos without having unacceptable tension in axial direction.

The solution of EP3038822 is adapted mostly for relatively restricted surfaces.

Accordingly, one aim of the invention is to provide a solution for fine embossing that allows to produce checkered-style and larger uniformly embossed areas in a step length of about 50 to 250 μm. An other aim is to provide a configuration which also reduces uncontrollable contraction in the axial direction while foils are being embossed. A further aim is to provide a solution that allows to produce the fine embossing over areas in an homogene manner on the foil.

SUMMARY OF INVENTION

In a first aspect the invention provides an embossing method allowing to emboss a material on both sides. The method comprises at least feeding the foil material into a roll nip between a pair of a first roll and a second roll, providing the first roll and the second roll each with a plurality of positive projections and a plurality of negative projections of identical shaped polyhedral structures, the positive projections are elevated above a mean cylindrical surface of their roll, and the negative projections are recesses reaching below the mean cylindrical surface of their roll, a first subset of the plurality of positive projections being disposed with a first periodicity on a first grid in axial direction and a second periodicity on the first grid in circumferential direction on the first roll, and a second subset of the plurality of negative projections being disposed with the first periodicity in axial direction and the second periodicity in circumferential direction on the first grid intertwined with the positive projections, in axial and circumferential directions respectively, and a third subset of the plurality of positive projections and a fourth subset of the plurality of negative projections being disposed on a second grid complementary to the first grid, on the second roll, each of the positive projections and the negative projections on the first roll during operation of the rolls and in the roll nip, except for projections located on edges of the first grid, being surrounded on all sides by positive projections and negative projections on the second roll, the positive projections of the first roll together with alternating corresponding negative projections on the second roll forming during the operation of the rolls and in the roll nip, a first straight line (y-y) substantially parallel to the axial direction, and the negative projections of the first roll together with alternating corresponding positive projections on the second roll forming during the operation of the rolls and in the roll nip, a second straight line (x-x) substantially parallel to the axial direction. The method is characterized in that it further comprises disposing in the first grid the positive projections and the negative projections such that in the axial direction on the first roll each positive projection shares a lateral base border with at least one negative projection adjacent to the positive projection, where the first straight line (y-y) and the second straight line (x-x) are coincident in a single third line (z-z), and during the operation of the rolls and in the roll nip, all lateral oblique surfaces of the positive and negative projections of the first roll are just above the surface in full faced view with the corresponding lateral oblique surfaces of the respective negative and positive projections of the second roll, thereby enabling a homogeneous distribution of pressure to the material.

In a preferred embodiment, the first roll is a motor roll and the pair of rolls is configured such that the motor roll drives the second roll.

In a further preferred embodiment, the first roll and the second roll are synchronized by means of synchronization means.

In a further preferred embodiment, the synchronization means comprise for each of the first roll and the second roll a teethed wheel, the teethed wheels cooperating to synchronize the first roll and the second roll during operation such that the teethed wheel of the first roll is connected with the teethed wheel of the second roll.

In a further preferred embodiment, the synchronization means comprise the positive projections and negative projections of the first roll and the second roll, the positive projections and the negative projections cooperating to synchronize a rotation of the first roll and the second roll during the operation of the rolls.

In a further preferred embodiment, the method further comprises providing at least one of the lateral oblique surfaces with shading structure means for producing through an intended embossing of the material an optical shading effect when light is projected o the embossed material.

In a further preferred embodiment, the step of providing at least one of the lateral oblique surfaces with shading structure means comprises providing pilxelizing embossing structures.

In a second aspect, the invention provides an embossing apparatus for embossing a material on both sides. The apparatus comprises at least a pair of a first roll and a second roll configured to emboss the material which is intended to be fed into a roll nip formed by the first and the second roll, the first roll and the second roll being provided each with a plurality of positive projections (P) and a plurality of negative projections (N) of identical shaped polyhedral structures, the positive projections are elevated above a mean cylindrical surface of their roll, and the negative projections are recesses reaching below the mean cylindrical surface of their roll, a first subset of the plurality of positive projections being disposed with a first periodicity in axial direction on a first grid and in a second periodicity in circumferential direction on the first grid on the first roll, and a second subset of the plurality of negative projection being disposed with the first periodicity on the first grid and with the second periodicity in circumferential direction on the first grid intertwined with the positive projections, in axial and circumferential directions respectively, and a third subset of the plurality of positive projections and a fourth subset of the plurality of negative projections being disposed on a second grid complementary to the first grid, on the second roll, each of the positive projections and the negative projections on the first roll being configured such that during intended operation of the rolls and in the roll nip, except for projections located on edges of the first grid, being surrounded on all sides by positive projections and negative projections on the second roll, the positive projections of the first roll together with alternating corresponding negative projections on the second roll forming during the intended operation of the rolls and in the roll nip, a first straight line (y-y) substantially parallel to the axial direction, and the negative projections of the first roll together with alternating corresponding positive projections on the second roll forming during the intended operation of the rolls and in the roll nip, a second straight line (x-x) substantially parallel to the axial direction. The apparatus is characterized in that on the first roll and on the second roll a disposition of the positive projections and the negative projections is configured such that in the axial direction on the first roll each positive projection shares a lateral base border with at least one negative projection adjacent to the positive projection, where the first straight line (y-y) and the second straight line (x-x) are coincident in a single third line (z-z), and during an intended operation of the rolls and in the roll nip, all lateral oblique surfaces of the positive and negative projections of the first roll are just above the surface in full faced view with the corresponding lateral oblique surfaces of the respective negative and positive projections of the second roll, thereby enabling a homogeneous distribution of pressure to the material.

In a further preferred embodiment, the first roll and the second roll comprise a surface, the surface comprising any one of a list comprising steel, metal, hard metal, ceramic.

In a further preferred embodiment, the surface further comprises a protective layer.

In a further preferred embodiment, at least one of the lateral oblique surfaces comprises shading structure means for producing through an intended embossing of the material an optical shading effect when light is projected on the embossed material.

In a further preferred embodiment, the shading structure means comprise pixelizing embossing structures.

In a further preferred embodiment, the first roll is motor roll and the pair of rolls is configured such that the motor roll drives the second roll.

In a further preferred embodiment, the first roll and the second roll are synchronized by means of synchronization means.

In a further preferred embodiment, the synchronization means comprise the positive projections and negative projections of the first roll and the second roll, the positive projections and the negative projections cooperating to synchronize a rotation of the first roll and the second roll during the operation of the rolls.

BRIEF DESCRIPTION OF THE DRAWINGS

The invention will be better understood through the description of preferred embodiments and in view of the drawings, wherein.

DETAILED DESCRIPTION OF PREFERRED EMBODIMENTS

Prior Art Embossing Pattern

Figure 1A:
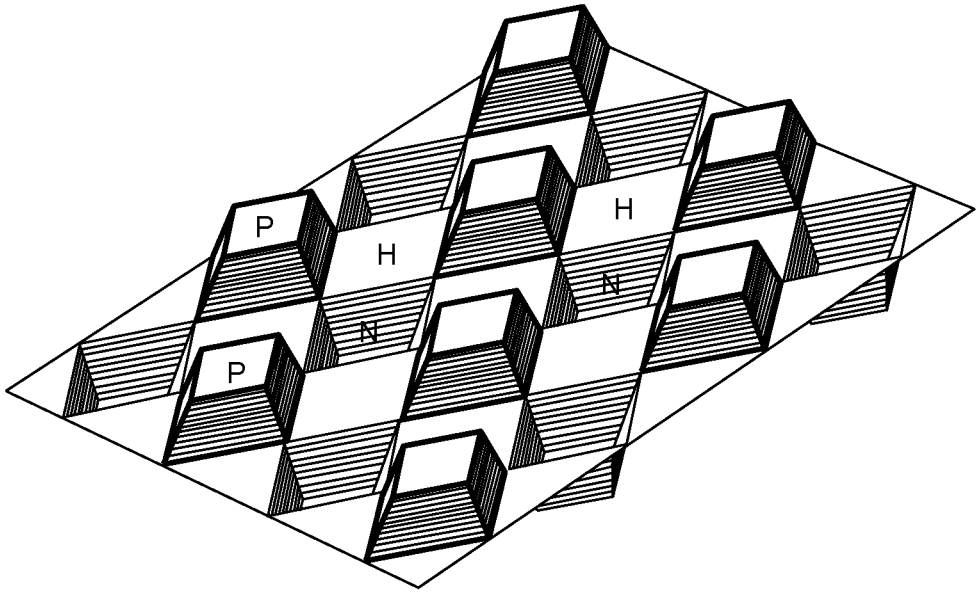
FIG.1a (prior art)
FIG. 1*a* represents an embossing structure for an embossing roll according to prior art.

Prior art patent publication DK131333 teaches a checkered and uniform embossing pattern such as the one shown in FIG. 1*a*. This embossing pattern is intended for the embossing of textile products. The embossing pattern comprises a plurality of positive projections and negative projections marked with P and N respectively. The embossing pattern is for an embossing system which makes use of a pair of rolls, whereby the textile product is fed into a roll nip between the pair of rolls—the embossing system is not shown in FIG. 1*a*. The embossing pattern corresponds to a structured surface of one of the rolls, whereby positive projections P are elevated above a mean cylindrical surface of one of the rolls, and negative projections N are recesses reaching below the mean cylindrical surface. The positive projections and negative projections P and N are identically shaped polyhedral structures, whereby the positive projections P are symmetrically shaped relative to the negative projections N when considered from the mean surface. An other one of the rolls (not shown in FIG. 1*a*) comprises on its cylindrical surface a matching embossing pattern which is positioned such that at a time of operation for embossing, both embossing patterns interact like congruent structures to emboss the textile product such that each of the projections on each roll becomes surrounded on all sides by projections of the other roll.

Coming back now to FIG. 1*a,* this further shows hills marked with the letter H, which are parts of the roll's cylindrical surface, are located at the previously mentioned mean surface, and that will produce no embossing, i.e., the hills H do not comprise any projections.

Figure 1B:
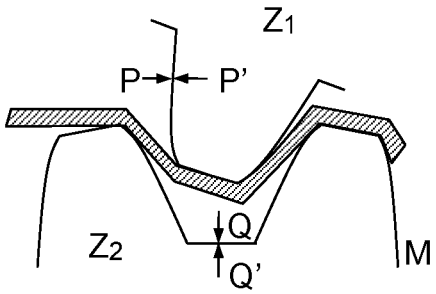
FIG.1b (prior art)
FIG. 1*b* schematically shows a sheet of paper being embossed using the embossing structure of FIG. 1*a* by means of a pairs of rolls according to prior art.
Figure 1C:
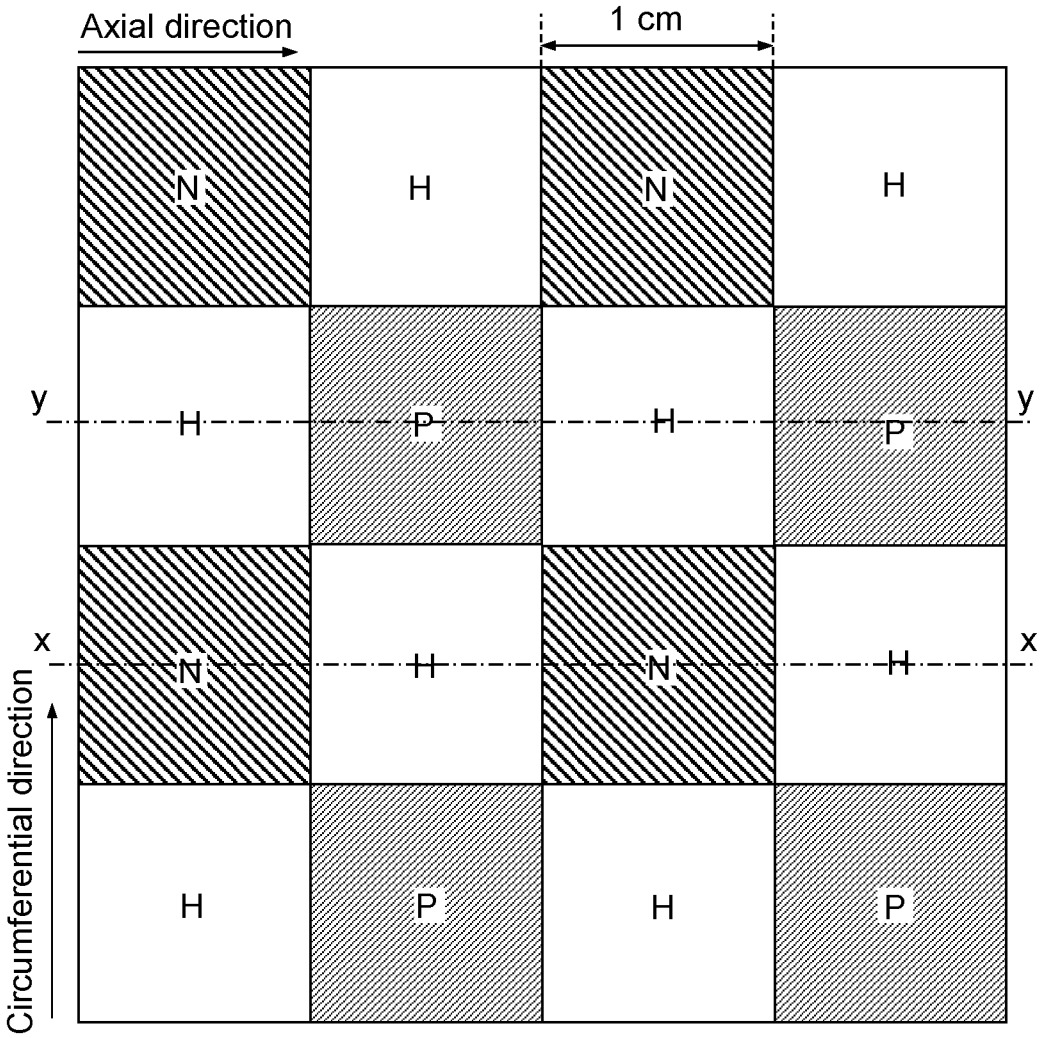
FIG.1c (prior art)
FIG. 1*c* is a layout plan of projections corresponding to embossing structures from FIG. 1*a* according to prior art.

In DK131333 the size of the projections is approximately 1 cm in any lateral direction as indicated by the double-arrow in FIG. 1*c*. The exact dimensions are irrelevant for the present explanation, it is here only intended to indicate an order of magnitude for the size of the projections in prior art.

The embossing patterns in DK131333 as used on a pair of congruent rolls, enable a processing of textile products while minimising a sectional contraction at the embossings. Accordingly, relatively powerful motors are required to provide high drive forces at a relatively low speed range—at least compared to the area of paper or thin foil embossing.

We now refer to FIG. 1*b* which also relates to the embossing process of DK131333. Compared to prior art publication U.S. Pat. No. 5,007,271, the embossing process of DK131333 involves partly the lateral oblique surfaces of the projections—the pressure contacts between the projections from each roll are point shaped—at P-P' on a positive projection $Z_1$ as represented in FIG. 1*b* or at Q-Q' at a bottom of a negative projection adjacent to positive projection $Z_2$, and thereby exerts a lateral embossing force on the surface of the textile product being embossed, the latter which is represented using a sectional view in form of a textured stripe that passes between positive projections $Z_1$ and $Z_2$. The positive projections $Z_1$ and $Z_2$ are mechanically produced and necessarily have edges that fail to have a 0-radius, i.e., they are lightly curved. While such an embossing process and embossing pattern may be useful in the textile product industry, it is undesirable to have pressure points such as P-P' and Q-Q', in optical uses of innerliners.

It is noted that for textile products uses, the optical properties of the embossed product have no importance, contrary to the material embossed using the present inventive process where the optical properties are of paramount importance.

FIG. 1*c* shows a layout plan of the projections corresponding to at least a part of embossing structures from FIG. 1*a*, including the positive projections P, the negative projections N and the hills H, whereby the latter are intended to leave parts of the textile products as non-embossed. If such embossing structures were adapted in size and used to emboss thin foil material or innerliner, the hills would not cause any improved optical reflection surface, and hence the brilliance of the foils could not be improved.

As shown in FIG. 1*c*, the plurality of positive projections P are disposed with a first periodicity on a first grid in axial direction and a second periodicity on the first grid in circumferential direction on a first roll. It is understood that the layout in FIG. 1*c* is that of the embossing pattern on the first roll from a pair that also comprises a second roll (not shown in FIG. 1*c*). In FIG. 1*c* the first periodicity is the same as the second periodicity, i.e., approximately 1 projection per 2 cm.

The plurality of negative projections N are disposed with the first periodicity in axial direction and the second periodicity in circumferential direction on the first grid intertwined with the positive projections P, in axial and circumferential directions respectively.

While not illustrated, the configuration of the embossing pattern on the second roll comprises a plurality of positive positive projections and a plurality of negative projections which are disposed on a second grid complementary to the first grid, on the second roll. This, among others, means that the periodicities in axial and circumferential directions are the same as on the first roll.

At a time of embossing, i.e., during operation of the rolls and in the roll nip, each of the positive projections and the negative projections, except for projections located on edges of the first grid at extremities in an axial direction of the first roll, is surrounded on all sides by positive projections and negative projections on the second roll.

The positive projections P of the first roll together with alternating corresponding negative projections N on the second roll form during the operation of the rolls and in the roll nip, a first straight line y-y substantially parallel to the axial direction, represented in FIG. 1*c*. It should for the sake of understanding be imagined that during operation the positive projections P of the first roll are penetrated in negative projections N of the second roll (not represented in FIG. 1*c*).

In addition, the negative projections N of the first roll together with alternating corresponding positive projections P on the second roll form during the operation of the rolls and in the roll nip, a second straight line x-x substantially parallel to the axial direction. It should for the sake of understanding be imagined that during operation the negative projections N of the first roll are penetrated by positive projections P of the second roll (not represented in FIG. 1*c*).

Embossing Pattern According to Invention

The embossing pattern according to the invention departs from the embossing pattern taught in DK131333.

Figure 2A:
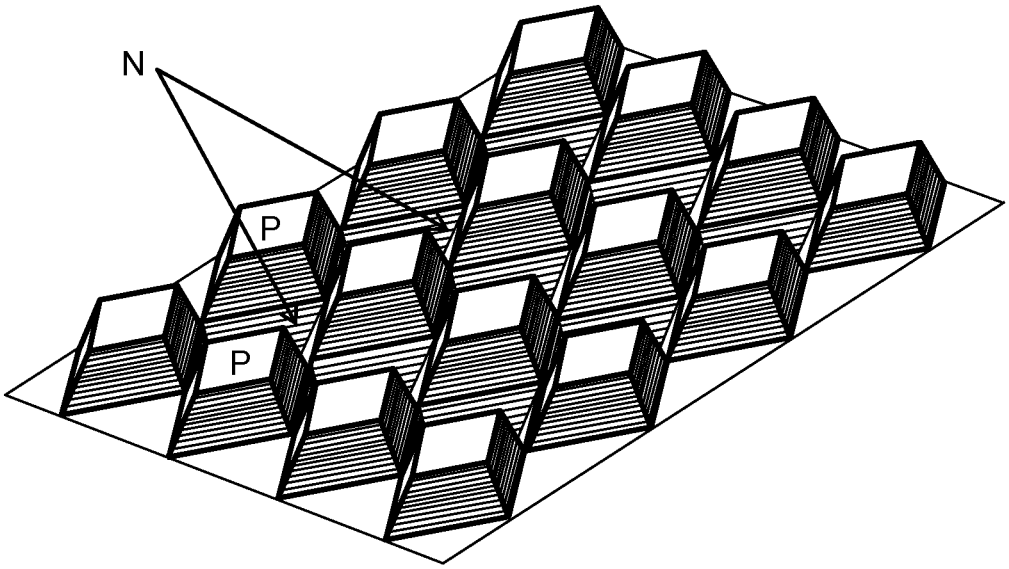
FIG. 2*a* represents an embossing structure for an embossing roll according to an example embodiment of the invention.

One distinguishing feature that differentiates the inventive embossing pattern from DK131333 is that it does away with the hills in the embossing pattern as known from DK131333, as is illustrated in FIG. 2*a*, where an embossing pattern according to an example embodiment of the invention is shown. In FIG. 2*a*, similar as in FIG. 1*a*, the embossing pattern corresponds to a structured surface of one of the rolls, whereby the positive projections P are elevated above a mean cylindrical surface of one of the rolls (not referenced in FIG. 2*a*), and the negative projections N are recesses reaching below the mean cylindrical surface. The positive projection P and the negative projections N are identically shaped polyhedral structures, whereby the positive projections P are symmetrically shaped relative to the negative projections N when considered from the mean surface. An other one of the rolls (not shown in FIG. 1*a*) comprises on its cylindrical surface a matching embossing pattern which is positioned such that at a time of operation for embossing, both embossing patterns interact like congruent structures to emboss the product or material on both sides, such that each of the projections on each roll becomes surrounded on all sides by projections on the other roll.

Figure 2B:
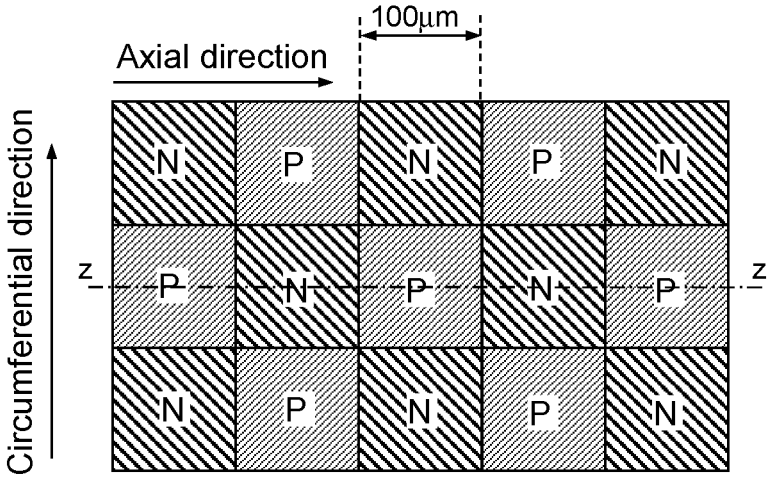
FIG. 2*b* is a layout plan of projections corresponding to embossing structures from FIG. 2*a;*

FIG. 2*b* shows a layout plan of projections corresponding to embossing structures from FIG. 2*a*, in fact only a part of the embossing pattern from FIG. 2*a*, comprising positive projections P and negative projections N. A double arrow shows an order of magnitude for the structures in the embossing pattern, which lies around 100 μm in any lateral direction. The exact dimensions are irrelevant for the present explanation, it is only intended to indicate an order of magnitude for the size of the projections in the invention.

The use of the embossing pattern of FIG. 2*a* and a corresponding inverse embossing pattern on respective rolls of a pair of embossing rolls, to emboss a foil or innerliner would confers a 100% embossing coverage of the embossed surface—in contrast to DK131333 where parts of the product corresponding to hills of the embossing pattern are not embossed. Such embossing configuration is schematically illustrated in FIG. 3, where two facing embossing patterns from the pair of rolls are positioned such that the positive projections P from the one roll correspond to the negative projection N from the other roll and vice versa.

Figure 3:
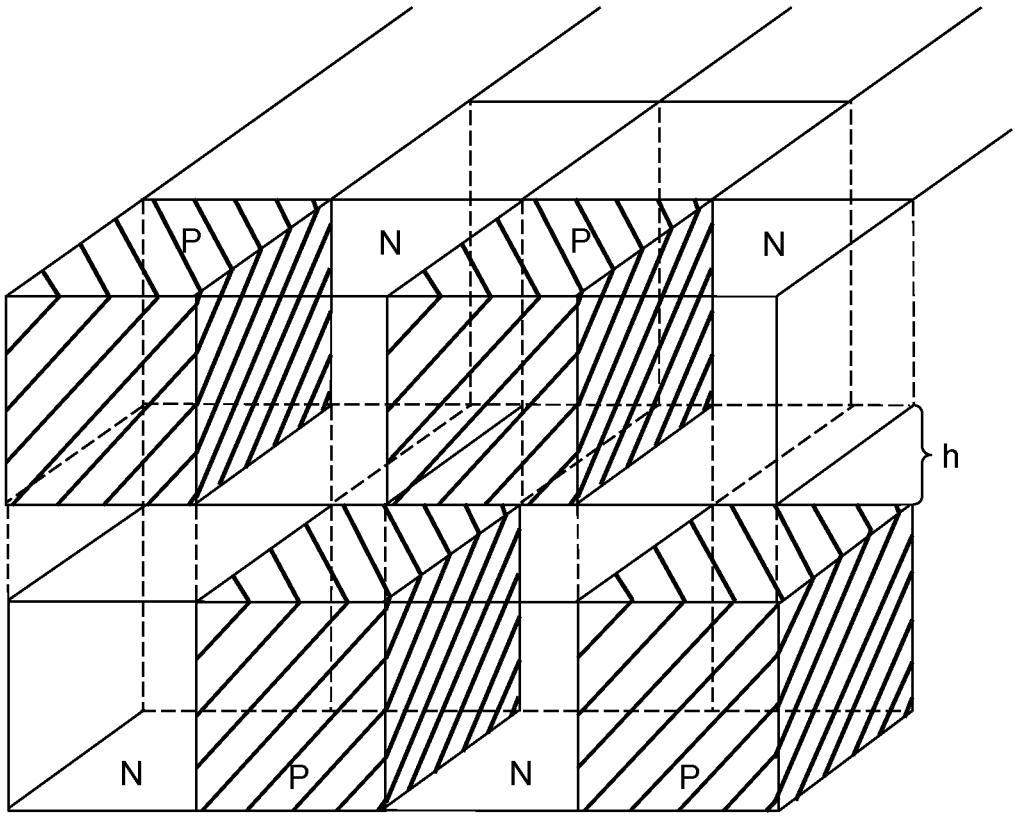
FIG. 3 schematically illustrates how embossing structures from two rolls are intended to interact in view of embossing, according to an example embodiment of the invention.

FIG. 3 illustrates the facing embossing patterns at rest, when the rolls are separated by a distance h and a sheet of material (not shown in FIG. 3) may be inserted in the roll nip, i.e., in the gap h. At the time of embossing, the rolls are firstly driven towards each other, and the positive projections P penetrate in the negative projections N, thereby embossing a sheet of material that would have been fed into the roll nip formed by the pair of rolls. While interpenetrated (not shown in FIG. 3), all lateral oblique surfaces of the projections of one roll—positive and negative—are just above the surface in full faced view with the corresponding lateral oblique surfaces of the respective negative and positive projections of the other roll. This enables a homogeneous distribution of pressure to the material being embossed. The fact that the surfaces as described are just above each other reflects the necessity to have some space between the projections from one roll and the other roll to allow the material to be positioned in between for embossing.

Returning to FIG. 2*b*, which for the sake of discussion represents the embossing pattern located on the first roll of a pair of rolls, it is to be imagined that a corresponding embossing pattern is located on the second roll of the pair of rolls (not represented in FIG. 2*b*). As is apparent from FIG. 2*b*, the positive projections P and the negative projections N are disposed in a grid such that in the axial direction, each positive projection P shares a lateral base border—in FIG. 2*b* these are represented as the lines delimitating the projections and separating one projection from the adjacent neighbouring projection—with a least one negative projection N adjacent to the positive projection P.

Furthermore the first straight line y-y and the second straight line x-x as defined for the prior art embossing structure in FIG. 1*c,* are coincident in a single third line z-z in the invention as shown in FIG. 2*b,* the main reason being that in the invention the embossing pattern does away with the hills as known from DK131333.

Figure 4:
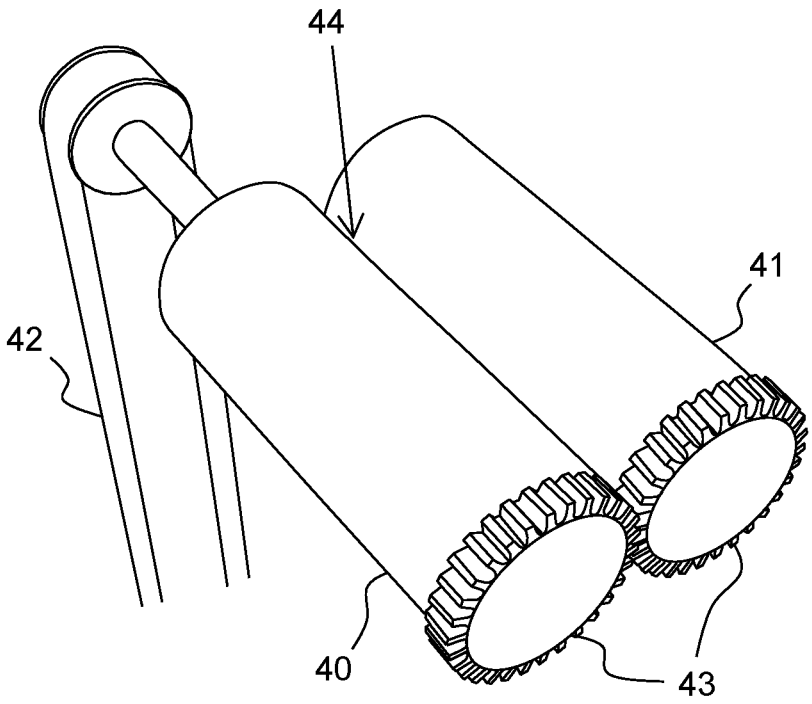
FIG. 4 illustrates an example embossing system for implementing the embossing with the embossing structure according to the invention.

FIG. 4 illustrates an example embodiment of an apparatus for embossing material on both sides according to the invention. The apparatus comprises a pair of a first roll 40 and a second roll 41, whereby the first roll 40 is driven by means of a drive mechanism 42, and transmits the drive force to the second roll 41 by means of toothed wheels 43, located at an extremity of each roll. The type of drive mechanism 42 and structure of the toothed wheels 43 to transmit the drive force are exemplary only and may be varied while remaining in the scope of the present invention. It may for example be that no toothed wheels are used, and that the drive is realized by the interactions of the projections of both embossing rolls with each other (not shown in FIG. 4). The material to be embossed on both of its sides (material not shown in FIG. 4), is intended to be inserted in roll nip 44. The surfaces of the first roll 40 and the second roll 41 are equipped with embossing patterns as explained in the present description, as for example the embodiment shown in FIG. 2*a* for one roll, and a corresponding opposite structure for the other roll.

Using the inventive embossing pattern, it is possible to obtain a homogeneous distribution of pressure to the material, i.e., a regular and homogenous balance between the pressure on the lateral oblique surfaces of the positive projections P and negative projections N, mitigated perhaps only by variations of the material thickness that occur over a certain range of tolerances. Furthermore, axial contraction of the embossed foil is reduced and a smoother surface is obtained compared to the older embossing technologies of the Applicant.

In a preferred embodiment, the embossing pattern and the shape of the positive projections and negative projections comprised therein may be configured such to restaure the full theoretical intensity of reflexion of a metalized sheet, after embossing. In a similar manner it is possible to configure the negative projections and positive projections in such a manner that an attenuation of reflection may be achieved.

Mechanical Tolerances

The embossing pattern according to the invention is for use in fine embossing.

Fine embossing may be defined by mechanical tolerances that are applicable to the manufacture of the fine embossing structures on the rolls, i.e., to positive and negative projections. More precisely, in case of fine embossing, the outline of the embossing structures on the rolls may have a total linear mistake in axial or radial direction of less than +/−7 μm and/or a radial angle mistake of less than 0.4°.

The tolerances for fine embossing structures are applicable for example to the manufacture of positive projection structures P and negative projection structures N of the embossing configuration shown in FIG. 3. The strict tolerances can be understood to be the result of an improved quality at the manufacture of the rolls. The tolerance may be dependent from the quality of surfaces of the rolls. It is therefore an advantage to use relatively hard material for the surface. For example, the tolerances at manufacture may be attained for rolls made of metal or hard metal, with a surface made of hard metal. An other example of suitable material combination includes a roll made of ceramic material or metal, and covered with a ceramic surface. The material indicated for the example rolls are particularly adapted for manufacture in the area of tolerances for fine embossing. The manufacture of such materials typically requires short pulsed lasers. It is usually advantageous to cover the surface of the embossing rolls with a suitable protective layer.

Figure 5:
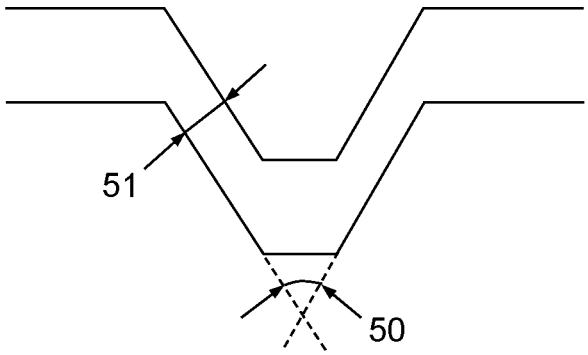
FIG. 5 schematically illustrates a positive projection and a negative projection from corresponding embossing rolls and allowable tolerances of manufacturing.

In a further preferred embodiment, a roll having a length of 150 mm—thus measured in axial direction—and a diameter of 70 mm will show positioning errors for the projections which may deviate from the desired position by +/−7 μm in radial direction, and ideally +/−7 μm in axial direction, whereby a height of a positive projection or depth of negative projection is in the order of 0.1 mm and this height has a tolerance of +/−5 μm. For an angle of two oblique lateral surfaces that are adjacent, 1 from a positive projection and the other from a negative projection on the counter roller, of for example 80°, it is desired to achieve a tolerance of less than 5°. Hence, rolls manufactured in this way will have a maximal linear mistake of +/−7 μm, and errors resulting from embossing with such rolls will be below 20 μm. Referring to FIG. 5, this represents a positive projection penetrated in a negative projection, wherein the angle must be given with a tolerance of less than 5° and the linear error affecting the distance 51 between the positive projection and the negative projection's walls must be determined with a maximum deviation of +/−7 μm.

The values of the preceding example embodiment will be influenced by measurement and manufacture—hence it may only be affirmed that a difference that was explicitly wanted is there if a linear deviation between the positive projection and negative projection of approximately 5 μm or more is present, as well as an angle deviation of at least 4°. The upper limit in the differences between the geometrical structures is set by the requirement that the rollers must in any case be able to cooperate with each other in an undisturbed manner.

As a matter of principle, any mechanical or laser manufacturing fails to produce absolutely plain walls when working on steel because of the natural properties of steel. This of course makes is difficult to determine angles between walls.

Any deliberate difference on an embossed foil, embossed by two corresponding and mutually attributed structures from cooperating rolls, will finally be dependent from the type of foil material, of its consistency as well as of the thickness of the material to be embossed.

Hence for example, the total linear difference for the embossing of a foil with 30 μm thickness will be around 40 μm, but for the embossing of a foil with, e.g., 300 μm thickness, it will be around 120 μm relative to an axial embossing length of 150 mm.

Shading Structures

The embossing pattern according to the invention may—in at least a preferred embodiment—be configured to enable the embossing of additional shading structures intended for producing an optical shading effect when light is projected on the embossed material. Generally speaking, such configuration involves providing at least a lateral surface of a positive and/or a negative projection, on at least one of the rolls in the pair of rolls, with shading structures.

Shading structures have been provided as scratches on material's surfaces in prior art, for example when rendering surfaces of gold wristwatches bodies matt. In the case of thin films or foil materials, such as used to make package innerliners, for example, it was to date only possible to produce shading effects by grading or deforming the pyramids—see for example EP 0 925 911 and EP 1 324 877. When using gradings it remains challenging to produce a local shading effect by which the shadow effect is independent from an angle of view. One exception which allows to obtain a better contrast consists in removing embossing structures, generally pyramidal structure—this enables the creation of optical logo surfaces.

The technology known as pixelization involves making on the surfaces of the thin films or foil materials a relatively large number of densely packed and randomly arranged pixels, which have individual heights of for example 10 μm from the embossing surface. This enables to prevent any direct reflexion of light projected on the surface rather than having the surface acting as a mirror. Light projected on the thus modified surface may even be absorbed depending on the size of the pixelization. Hence this allows to make very fine gradings that produce pleasing esthetical effects.

The shading structures fit on the lateral surfaces of the positive and negative projections without impeding the process of fine embossing. In case the positive projections and negative projections have respectively a flattened top or bottom, the shading structures may also be made on surfaces of the projections, wherein theses surfaces are created by the flattening.

FIGS. 6 to 9 contain examples of a same embossing pattern, which according to preferred embodiments exhibit shading structures on lateral surfaces or flattened top and/or bottom surfaces of the projections.

Figure 6:
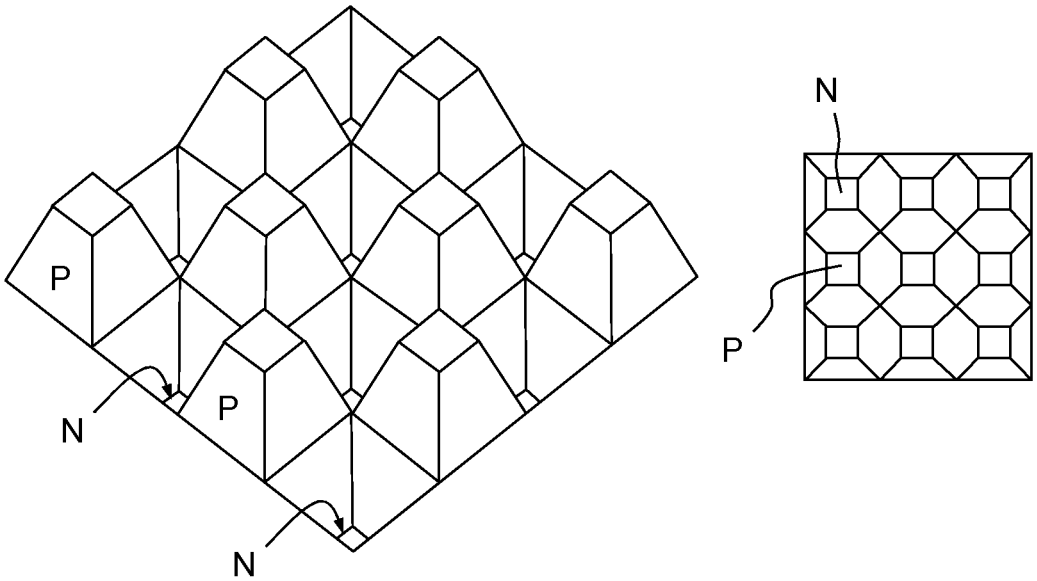
FIG. 6 schematically illustrates an embossing pattern according to an example embodiment of the invention.

FIG. 6 schematically illustrates in a 3-dimensional view an embossing pattern according to the invention without any shading structure means on any surface. The embossing pattern comprises positive projections P with flattened tops, and negative projections N with flattened bottoms. The square at the right of FIG. 6 represents a map of the embossing pattern as seen from above.

Figure 7:
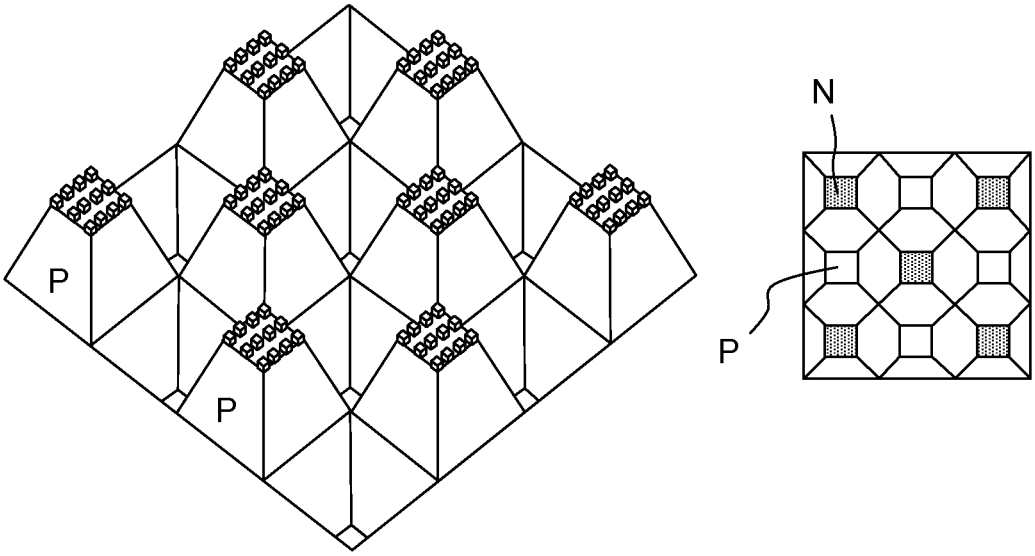
FIGS. 7-9 schematically illustrates the embossing pattern of FIG. 6, in which selected surfaces are covered by shading structure means according to example embodiments of the invention.

FIG. 7 schematically illustrates a similar embossing pattern as in FIG. 6, in which a part of the surfaces of positive projections P, more specifically their flattened top surfaces comprise shading structure means represented as cube shaped asperities affixed to the flattened surface in a regular distances from each other. The cube shape is for illustration only and may be varied according to the actual needs. The square at the right of FIG. 7 represents a map of the embossing pattern as seen from above, wherein the textured portions correspond to surfaces of the embossing pattern that comprise shading structures, and the non-textured portions to surfaces that don't comprise any shading structures.

Figure 8:
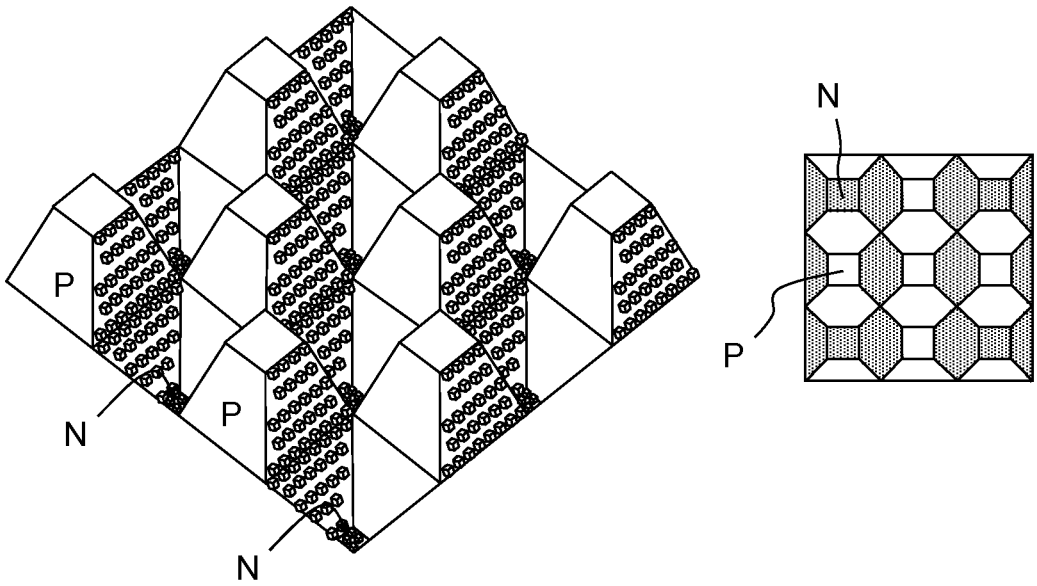

FIG. 8 schematically illustrates a configuration in which, partly similar as in FIG. 7, a part of the lateral surfaces of positive projections P but also of negative projections N comprise shading structure means. In this example the flattened bottom surfaces from the negative projections N specifically comprise such shading structures, while the flattened top surface of the positive projections don't. The square at the right of FIG. 8 represents a map of the embossing pattern as seen from above, wherein the textured portions correspond to surfaces of the embossing pattern that comprise shading structures, and the non-textured portions to surfaces that don't comprise any shading structures.

Figure 9:
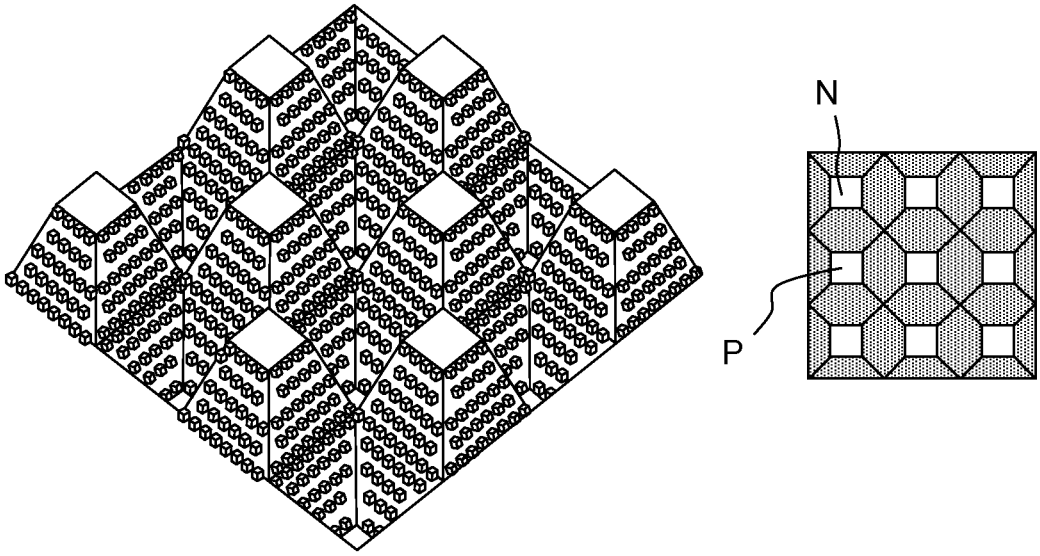

FIG. 9 schematically illustrates a further configuration in which all surfaces except the flattened top surface of the positive projections P and the flattened bottom surfaces of the negative projections N, carry shading structures—the surfaces without shading are represented in plain white. Again the square at the right of FIG. 9 represents a map of the embossing pattern as seen from above, wherein the textured portions correspond to surfaces of the embossing pattern that comprise shading structures, and the non-textured portions to surfaces that don't comprise any shading structures.

Example Embossing Patterns

Figure 10:
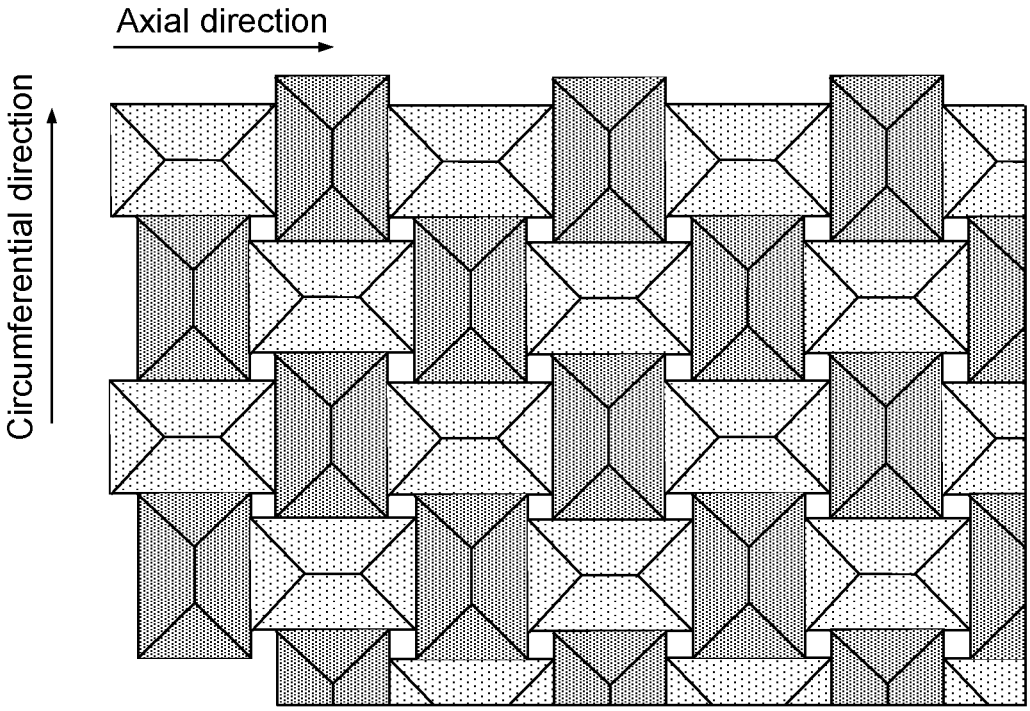
FIG. 10 schematically illustrates an embossing pattern according to a preferred embodiment of the invention.

FIG. 10 illustrates an example embodiment of an embossing pattern in a view from above, in a very schematic manner in order to show the principle only, to be realized on one roll of the pair of rolls according to the invention. Of course for the purpose of embossing a corresponding embossing pattern must be realised for the other one of the pair of rolls (not represented in FIG. 10).

In the example of FIG. 10, a plurality of positive projections represented by the darker rectangles and a plurality of negative projections represented by the lighter rectangles are respectively disposed. Since the positive projections and the negative projections are identical polyhedral shapes, they have the same length, width and height. The positive projections are oriented lengthwize perpendicular to the lengthwise direction of the negative projections, and are aligned in axial direction, but also in circumferential direction. The length direction of the negative projections is oriented parallel to the axial direction, while the length direction of the positive projection is oriented parallel to the circumferential direction.

A first periodicity of the negative projections in axial direction is the same as a periodicity of the positive projections in axial direction. A second periodicity of the negative projections in circumferential direction is the same as a periodicity of the positive projections in circumferential direction. The first periodicity and the second periodicity directly depend on the length and width values of the negative and positive projection, but needn't be the same.

The negative projections are aligned with the positive projections in axial direction such that the projection structures are adjacent. Similarly the negative projections are aligned with the positive projections in circumferential direction such that the projection structures are adjacent.

The negative and positive projections in axial direction, from one line to the next adjacent line, are offset by ½ period distance.

Figure 11:
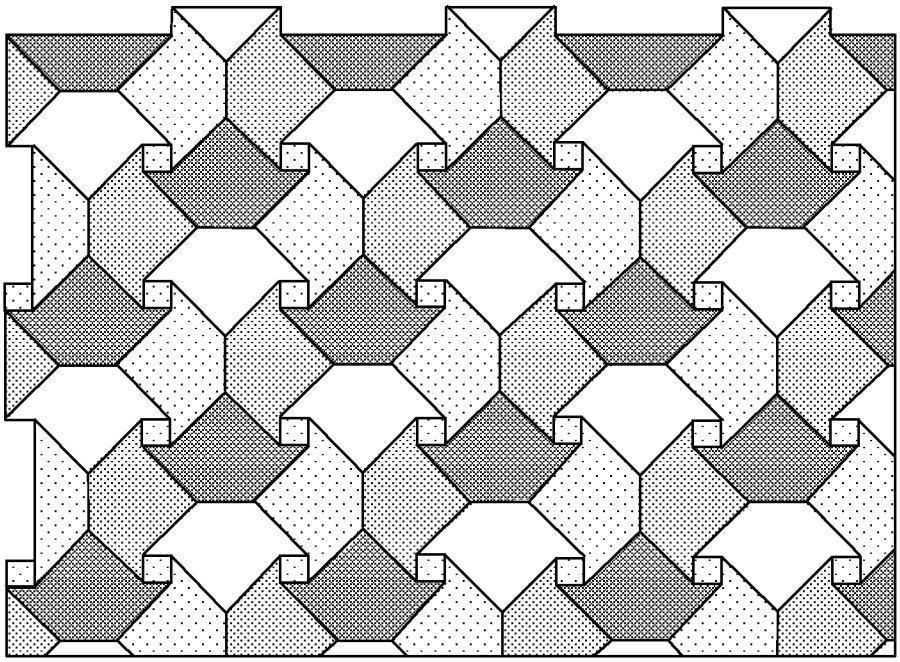
FIGS. 11-18 contain schematic illustrations of embossing patterns according to preferred embodiments of the invention.

FIG. 11 shows a further example embodiment of an embossing pattern in a view from above, to be realized on one of the pair of rolls according to the invention. The embossing pattern comprises wedges in positive projections and negative projections, whereby the apex of the wedge is a straight segment, and the apex of positive projection wedges is perpendicular to the apex of negative projection wedges—the bottom of the projection. Of course the negative projections and the positive projections are identical shaped polyhedral structures. The surfaces shown in different textures, except for the squares, represent surfaces that are in an angle to each other and also to the plane of the figure.

Similar as in FIG. 10, two successive projections on an axial line, i.e., a negative projection and its adjacent positive projection, and the two projections adjacent on a same side in circumferential direction all 4 together form a square surface that is flat and at the level of the mean surface of the roll. As a result, the flat square surface will not produce any embossing of material at the time of embossing.

Figure 12:
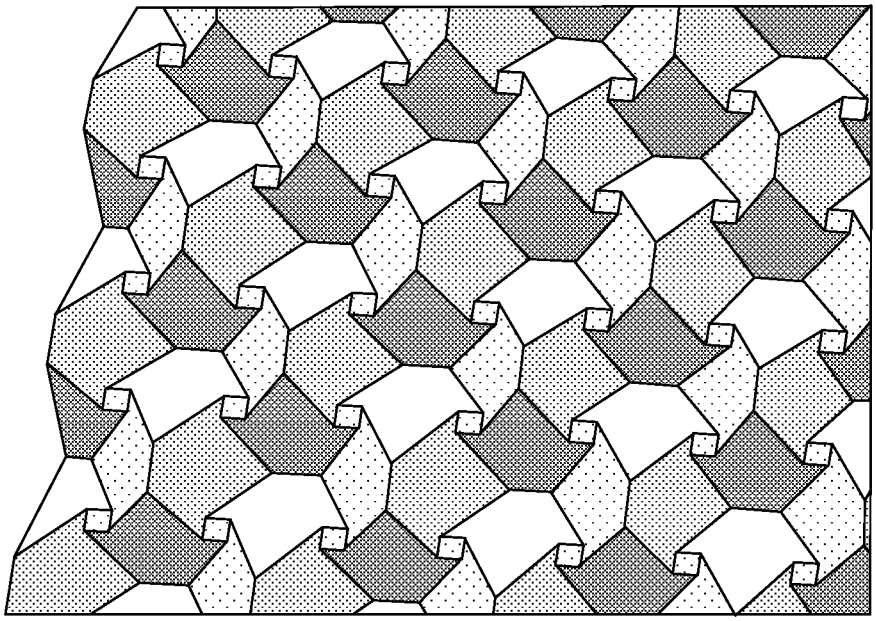

FIG. 12 shows the embossing pattern of FIG. 11 as viewed from an angle to obtain a 3 dimensional illustration, intended to complete the understanding of FIG. 11.

Figure 13:
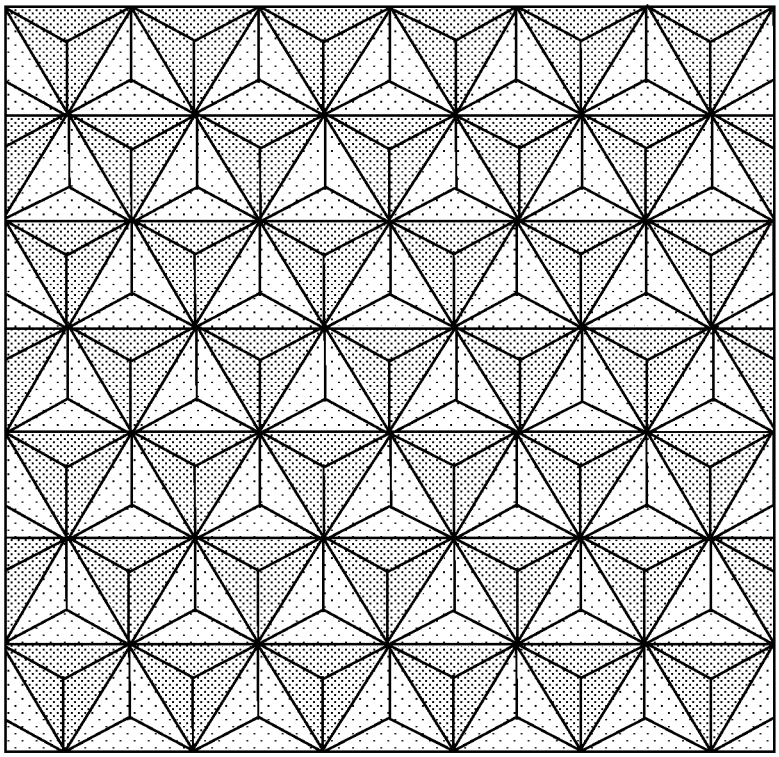

FIG. 13 shows a further example embodiment of an embossing pattern in a view from above, and containing positive projections, the lateral sides of which are triangular surfaces, and negative projections having the same shape but inverted. Dark textured surfaces represent positive projections while lighter textured surfaces represent negative projections.

Figure 14:
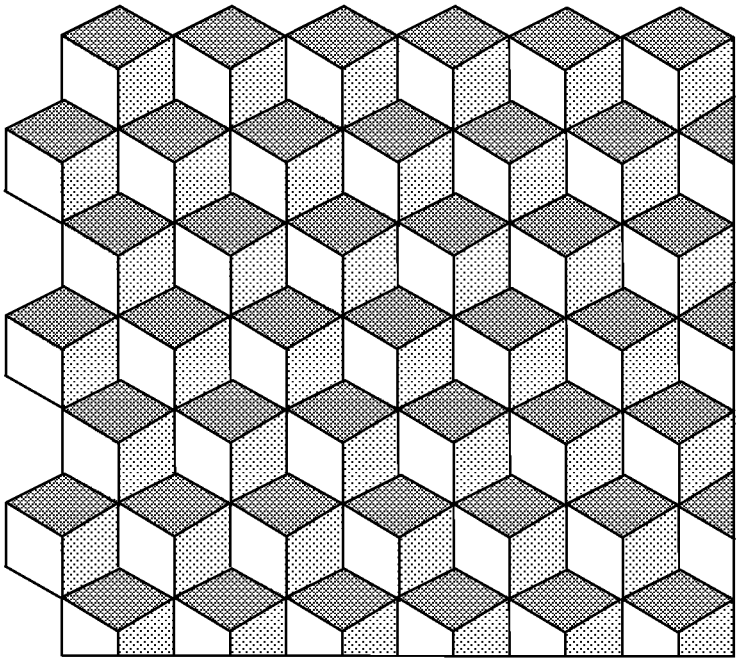

FIG. 14 illustrates a further example embodiment of an embossing patter in a view from above made of tetrahedrons. The surfaces shown in different textures represent surface that are in an angle to each other and also to the plane of the figure.

Figure 15:
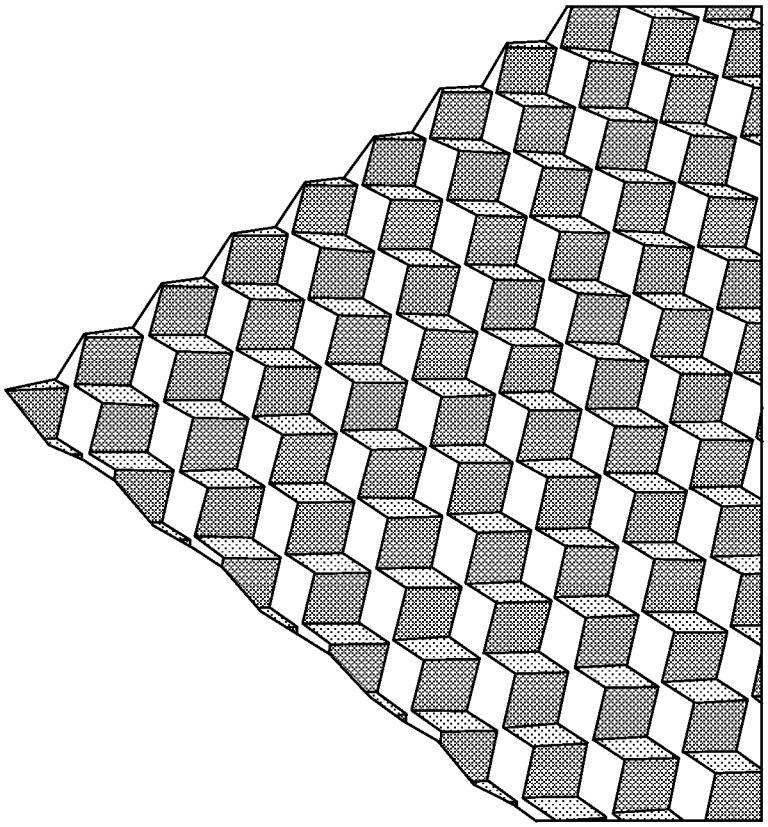

FIG. 15 shows the embossing pattern of FIG. 14 as viewed from an angle to obtain a 3-dimensional illustration, intended to complete the understanding of FIG. 14.

Figure 16:
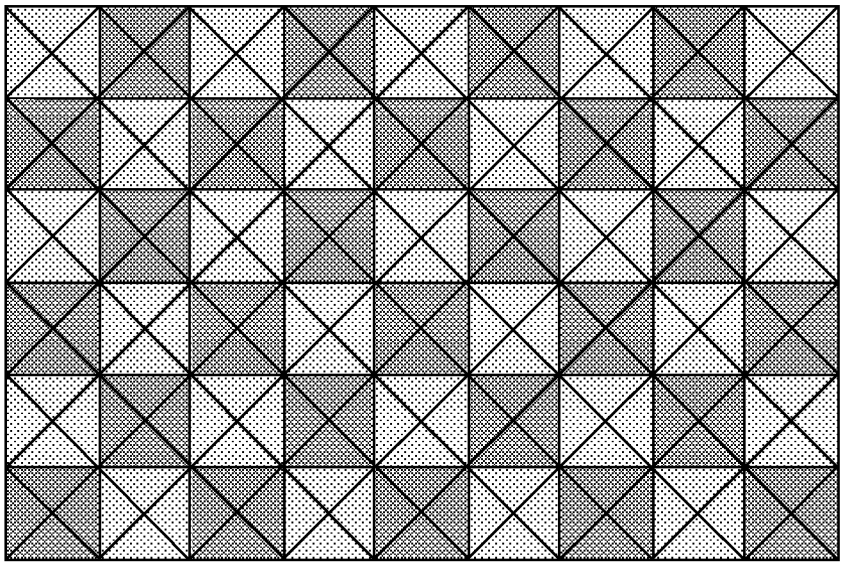

FIG. 16 illustrates a further embodiment of an embossing pattern in which the outline of the base of either one of the positive projections and the negative projections is a square. Dark textured surfaces represent positive projections while lighter textured surfaces represent negative projections.

Figure 17:
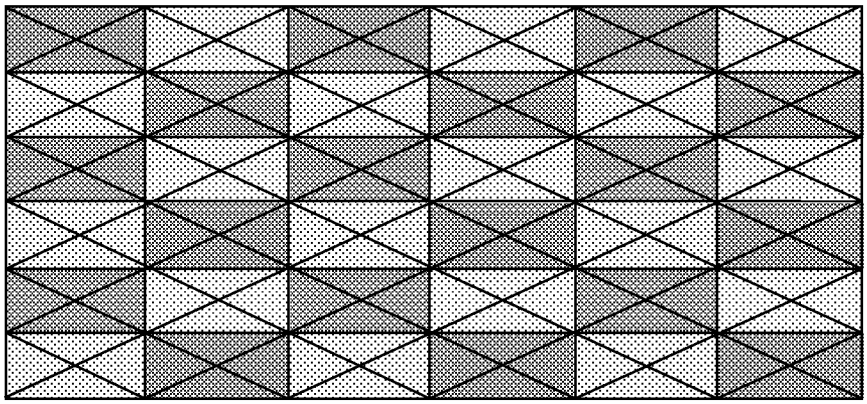

FIG. 17 illustrates a further embodiment of an embossing pattern in which the outline of the base of either one of the positive projections and the negative projections is a rectangle. Dark textured surfaces represent positive projections while lighter textured surfaces represent negative projections.

Figure 18:
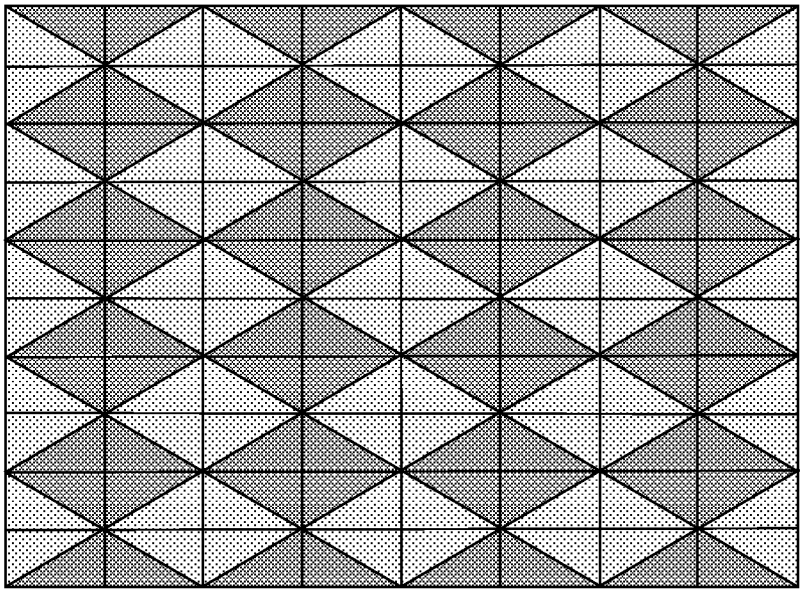

FIG. 18 illustrates a further embodiment of an embossing pattern in which the outline of the base of either one of the positive projections and the negative projections is a rhomboid. Dark textured surfaces represent positive projections while lighter textured surfaces represent negative projections.

The invention claimed is:

1. An embossing method for embossing a foil material on both sides, the method comprising the steps of:

feeding the foil material into a roll nip between a pair of a first roll and a second roll, the foil material including a metal layer, the first roll and the second roll each having a plurality of positive projections and a plurality of negative projections of identical shaped polyhedral structures, the positive projections elevated above a mean cylindrical surface of their roll, and the negative projections are recesses reaching below the mean cylindrical surface of their roll, a first subset of the plurality of positive projections disposed on the first roll with a first periodicity on a first grid in an axial direction and a second periodicity on the first grid in a circumferential direction of the first roll, and a first subset of the plurality of negative projections disposed on the first roll with the first periodicity in the axial direction and the second periodicity in the circumferential direction of the first roll on the first grid, the first subsets of the positive and negative projections interspersed between one another in axial and circumferential directions of the first roll, respectively, and a second subset of the plurality of positive projections and a second subset of the plurality of negative projections disposed on a second grid complementary to the first grid, on the second roll, each of the positive projections and the negative projections on the first roll during operation of the rolls and in the roll nip, except for projections located on edges of the first grid, being surrounded on all sides by positive projections and negative projections on the second roll, the positive projections of the first roll together with alternating corresponding negative projections on the second roll forming during the operation of the rolls and in the roll nip, a first straight line (y-y) substantially parallel to the axial direction, and the negative projections of the first roll together with alternating corresponding positive projections on the second roll forming during the operation of the rolls and in the roll nip, a second straight line (x-x) substantially parallel to the axial direction, and disposing in the first grid the positive projections and the negative projections such that in the axial direction on the first roll each positive projection shares a lateral base border with at least one negative projection adjacent to the positive projection, wherein the first straight line (y-y) and the second straight line (x-x) are coincident in a single third line (z-z), wherein during the operation of the rolls and in the roll nip, lateral oblique surfaces of the positive and negative projections of the first roll are arranged to be substantially in parallel with lateral oblique surfaces of the respective negative and positive projections of the second roll that are facing each other, to enable a homogeneous distribution of pressure to the foil material, wherein a common continuous surface is formed by a lateral oblique surface of a positive projection and a lateral oblique surface of a negative projection, the positive and negative projections neighboring each other and are located on the same roll, wherein no intervening flat portion is present between the corresponding lateral oblique surfaces of the positive and negative projections that are neighboring each other and are located on the same roll.

2. The method of claim 1, wherein the first roll is a motor roll and the pair of rolls is configured such that the motor roll drives the second roll.

3. The method of claim 1, wherein the first roll and the second roll are synchronized by a synchronization device.

4. The method of claim 3, wherein the synchronization device comprise for each of the first roll and the second roll a teethed wheel, the teethed wheels cooperating to synchronize the first roll and the second roll during operation such that the teethed wheel of the first roll is connected with the teethed wheel of the second roll.

5. The method of claim 3, wherein the synchronization device comprise the positive projections and negative projections of the first roll and the second roll, the positive projections and the negative projections cooperating to synchronize a rotation of the first roll and the second roll during the operation of the rolls.

6. The method of claim 1, wherein at least one of lateral oblique surfaces includes a shading structure for producing through an intended embossing of the foil material an optical shading effect when light is projected on the embossed foil material.

7. The method of claim 6, wherein the at least one of the lateral oblique surfaces with the shading structure comprises providing pixelizing embossing structures.

8. The method of claim 1, wherein a tolerance angle between the lateral oblique surfaces of the positive and negative projections of the first roll and the lateral oblique surfaces of the respective negative and positive projections of the second roll is less than 5°.

9. The method of claim 1, wherein a maximum deviation of a distance between the lateral oblique surfaces of the positive and negative projections of the first roll and the lateral oblique surfaces of the respective negative and positive projections of the second roll is +/−7 μm.

10. The method of claim 1, wherein the foil material to be embossed has a thickness in a range from 30 μm to 120 μm.

11. An embossing apparatus for embossing a foil material on both sides, the apparatus comprising:

a pair of a first roll and a second roll configured to emboss the foil material which is intended to be fed into a roll nip formed by the first and the second roll, the foil material including a metal layer, the first roll and the second roll having a plurality of positive projections (P) and a plurality of negative projections (N) of identical shaped polyhedral structures, the positive projections are elevated above a mean cylindrical surface of their roll, and the negative projections are recesses reaching below the mean cylindrical surface of their roll, a first subset of the plurality of positive projections disposed on the first roll with a first periodicity on a first grid in an axial direction and in a second periodicity on the first grid in a circumferential direction of the first roll, and a first subset of the plurality of negative projection disposed on the first roll on the first grid with the first periodicity in the axial direction and with the second periodicity in the circumferential direction of the first roll on the first grid, the first subsets of the positive and negative projections interspersed between one another in axial and circumferential directions of the first roll, respectively, and a second subset of the plurality of positive projections and a second subset of the plurality of negative projections disposed on a second grid complementary to the first grid, on the second roll, each of the positive projections and the negative projections on the first roll being configured such that during intended operation of the rolls and in the roll nip, except for projections located on edges of the first grid, being surrounded on all sides by positive projections and negative projections on the second roll, the positive projections of the first roll together with alternating corresponding negative projections on the second roll forming during the intended operation of the rolls and in the roll nip, a first straight line (y-y) substantially parallel to the axial direction, and the negative projections of the first roll together with alternating corresponding positive projections on the second roll forming during the intended operation of the rolls and in the roll nip, a second straight line (x-x) substantially parallel to the axial direction, wherein on the first roll and on the second roll a disposition of the positive projections and the negative projections is configured such that in the axial direction on the first roll each positive projection shares a lateral base border with at least one negative projection adjacent to the positive projection, wherein the first straight line (y-y) and the second straight line (x-x) are coincident in a single third line (z-z), and wherein during an operation of the rolls and in the roll nip, lateral oblique surfaces of the positive and negative projections of the first roll are arranged to be substantially in parallel with lateral oblique surfaces of the respective negative and positive projections of the second roll that are facing each other, thereby enabling a homogeneous distribution of pressure to the foil material, wherein a common continuous surface is formed by a lateral oblique surface of a positive projection and a lateral oblique surface of a negative projection, the positive and negative projections neighboring each other and are located on the same roll, wherein no intervening flat portion is present between the corresponding lateral oblique surfaces of the positive and negative projections that are neighboring each other and are located on the same roll.

12. The apparatus of claim 11 wherein the first roll and the second roll comprise a surface, the surface comprising any one of a list comprising steel, metal, hard metal, ceramic.

13. The apparatus of claim 12, wherein the surface further comprises a protective layer.

14. The apparatus of claim 11, wherein at least one of the lateral oblique surfaces comprises a shading structure for producing through an intended embossing of the foil material an optical shading effect when light is projected on the embossed foil material.

15. The apparatus of claim 14, wherein the shading structure includes pixelizing embossing structures.

16. The apparatus of claim 11, wherein the first roll includes a motor roll and the pair of rolls is configured such that the motor roll drives the second roll.

17. The apparatus of claim 16, wherein the first roll and the second roll are synchronized by a synchronization device.

18. The apparatus of claim 16, wherein the synchronization device comprise the positive projections and negative projections of the first roll and the second roll, the positive projections and the negative projections cooperating to synchronize a rotation of the first roll and the second roll during the operation of the rolls.

19. The apparatus of claim 11, wherein a tolerance angle between the lateral oblique surfaces of the positive and negative projections of the first roll and the lateral oblique surfaces of the respective negative and positive projections of the second roll is less than 5°.

20. The apparatus of claim 11, wherein a maximum deviation of a distance between the lateral oblique surfaces of the positive and negative projections of the first roll and the lateral oblique surfaces of the respective negative and positive projections of the second roll is +/−7 μm.

21. The apparatus of claim 11, wherein the foil material to be embossed has a thickness in a range from 30 μm to 120 μm.

* * * * *